US006064746A

United States Patent [19]

Nakamura et al.

[11] Patent Number: 6,064,746

[45] Date of Patent: May 16, 2000

[54] PIEZOELECTRIC SPEAKER

[75] Inventors: Takeshi Nakamura, Uji; Yoshiaki Heinouchi, Joyo, both of Japan

[73] Assignee: Murata Manufacturing Co., Ltd., Japan

[21] Appl. No.: 08/867,288

[22] Filed: Jun. 2, 1997

[51] Int. Cl.[7] ..... H04R 25/00

[52] U.S. Cl. ..... 381/351; 310/324; 381/190; 381/353

[58] Field of Search ..... 381/190, 191, 381/173, 353, 354; 310/324, 800

[56] References Cited

U.S. PATENT DOCUMENTS

| | | | |
|---|---|---|---|
| 2,399,513 | 4/1946 | Shapiro | 381/173 |
| 2,773,942 | 11/1956 | Christensen | 381/190 |
| 4,413,198 | 11/1983 | Bost | 310/324 |
| 4,700,100 | 10/1987 | Congdon et al. | 310/332 |
| 4,714,133 | 12/1987 | Skaggs, Jr. | 181/160 |
| 5,318,837 | 6/1994 | Yoshinaka et al. | 428/328 |
| 5,386,479 | 1/1995 | Hersh | 381/190 |

*Primary Examiner*—Curtis A. Kuntz
*Assistant Examiner*—Dionne N. Harvey
*Attorney, Agent, or Firm*—Graham & James LLP

[57] ABSTRACT

A piezoelectric speaker has a substantially reduced size and reproduces sound in the low sound range. The piezoelectric speaker includes a cylindrical main body. First and second sounding members are secured to apertures of both sides of the main body in an air tight arrangement via ringed dampers made of rubber. An external opening is created at the middle of a side surface of the main body. The opening is created so as to have an area which is less than area of a vibrating portion of the sounding members. Sound absorbing members are provided within the main body, on the outside of the first sounding member and on the outside of the second sounding member. Caps having a plurality of holes are secured to the apertures of the both sides of the main body so as to cover the sound absorbers. The main body is supported on concave portions of leg members.

23 Claims, 4 Drawing Sheets

PIEZOELECTRIC SPEAKER

BACKGROUND OF THE INVENTION

1. Field of the Invention

The present invention relates to a piezoelectric speaker and more particularly, to a piezoelectric speaker having sounding members including piezoelectric bodies preferably made of piezoelectric ceramics and which are vibrated in response to receiving electrical signals.

2. Description of Prior Art

Generally, it is not possible to significantly increase an amplitude of sound waves generated by a sounding member of a piezoelectric speaker because the sounding member comprises a piezoelectric body made of ceramics. As a result, it is necessary to increase the amplitude of the sound waves by other means or to increase a vibrating area of the piezoelectric speaker in order to reproduce sound in a low sound range. Thus, a piezoelectric speaker which provides less amplitude requires a large diaphragm.

However, even if such a large diaphragm is used for the piezoelectric speaker, it is necessary to prevent a sound canceling effect caused by sound waves which reflect between front and back surfaces of the diaphragm, so that a large speaker case or housing a large baffle plate is required, thereby increasing the size of the speaker.

SUMMARY OF THE INVENTION

To overcome the problems described above, the preferred embodiments of the present invention provide an improved piezoelectric speaker which has a substantially reduced size and is able to reproduce sound in the low sound range. A preferred embodiment of the present invention provides a piezoelectric speaker which comprises a cylindrical main body; a first sounding member provided at an aperture of a first end of the main body in an air tight arrangement, the first sounding member including a first group of piezoelectric members adapted to be vibrated in response to receiving electrical signals; a second sounding member which is provided at an aperture of a second end of the main body in an air tight arrangement, the second sounding member including a second group of piezoelectric members adapted to be vibrated in response to receiving electrical signals, the first and second groups of piezoelectric bodies being arranged to be vibrated in a direction in which internal pressure of the main body increases or decreases at the first and the second sounding members and an external opening having an area smaller than an area of a vibrating portion of each of the first and second sounding members is disposed at a side portion of the main body.

A first cover member may be provided outside of the first sounding member so that the first cover member covers the first sounding member, and a second cover member may be provided outside of the second sounding member so that the second cover member covers the second sounding member. Holes may be provided in the first and the second cover members.

A resonant frequency inside the main body may be different from a resonant frequency inside the first and second cover members. A resonant frequency inside of each of the first and second cover members may be equal to each other or may be different.

Sound absorbers for absorbing and attenuating a component of sound waves in a high sound range may be provided within the main body, inside of the first cover member, and inside of the second cover member, respectively, in the inventive piezoelectric speaker.

Further, one input terminal for inputting one channel signal of a stereo signal may be connected to the first sounding member and another input terminal for inputting another channel signal of the stereo signal may be connected to the second sounding member in the inventive piezoelectric speaker.

When electrical signals are input to the first and second sounding members so that the pressure within the main body increases or decreases at the first and second sounding members at the same time in the piezoelectric speaker, sound waves are generated within the main body by the first and second members and are radiated from the external opening in the main body. Because the area of the external opening of the main body is smaller than the area of the vibrating portion of the sounding body, an amplitude of the sound waves radiated from the external opening of the main body becomes larger than an amplitude of the sound waves generated from the sounding members. Accordingly, the inventive piezoelectric speaker can reproduce sound waves in the low sound range without using a large diaphragm, a large case or a large baffle plate.

Therefore, the preferred embodiments of the present invention provide a piezoelectric speaker having a substantially reduced size for reproducing sound waves in the low sound range.

Also, since a plurality of resonant frequencies in the low sound range are provided in the preferred embodiments of the present invention, a band of the low sound range may be extended, thereby improving the reproduced sound level in the low sound range.

Since small-sized, thin piezoelectric elements are used in the preferred embodiments of the present invention, the size of a speaker can be reduced. Also, because sound waves having large amplitude are radiated from the openings of the main body in the preferred embodiments of the present invention, the low sound range can be fully reproduced.

It is noted that because the components of sound waves in the high sound range generated from the first and second sounding members may be absorbed and attenuated by providing the sound absorbers for absorbing and attenuating the component of the sound waves in the high sound range within the main body, between the outside of the first sounding member and the first cover member and between the outside of the second sounding member and the second cover member of the inventive piezoelectric speaker, the output of the low sound range of the sound waves thus reproduced by the speaker is substantially increased as a result.

Further, the inventive piezoelectric speaker may be used as a low sound range speaker at the center of a 3D system by connecting one input terminal for inputting one channel signal of a stereo signal with the first sounding member and by connecting another input terminal for inputting another channel signal of the stereo signal with the second sounding member.

These and other elements, features, and advantages of the preferred embodiments of the present invention will be apparent from the following detailed description of the preferred embodiments of the present invention, as illustrated in the accompanying drawings.

DETAILED DESCRIPTION OF PREFERRED EMBODIMENTS

Figure 1:
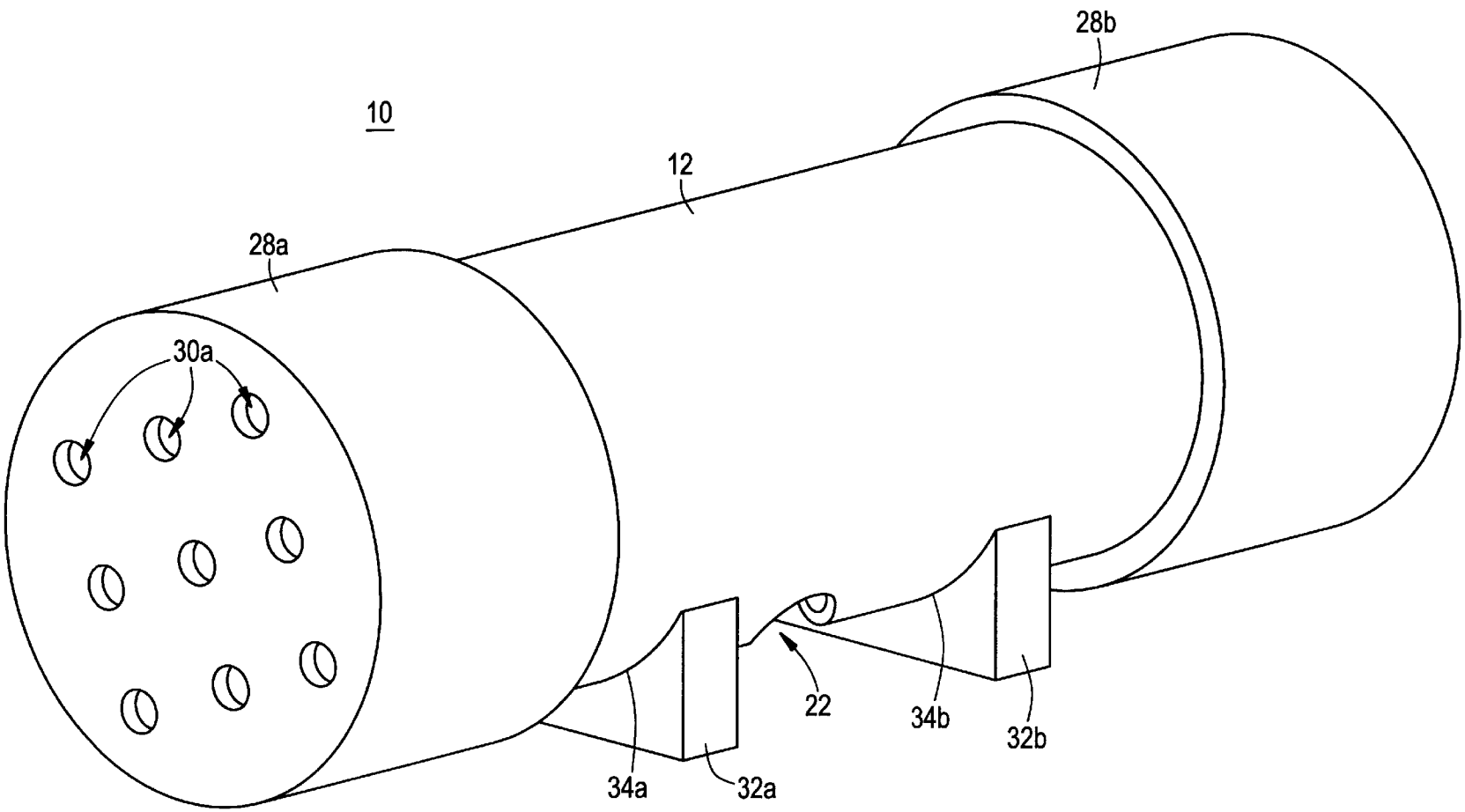
FIG. 1 is a perspective view showing a preferred embodiment of the present invention.
Figure 2:
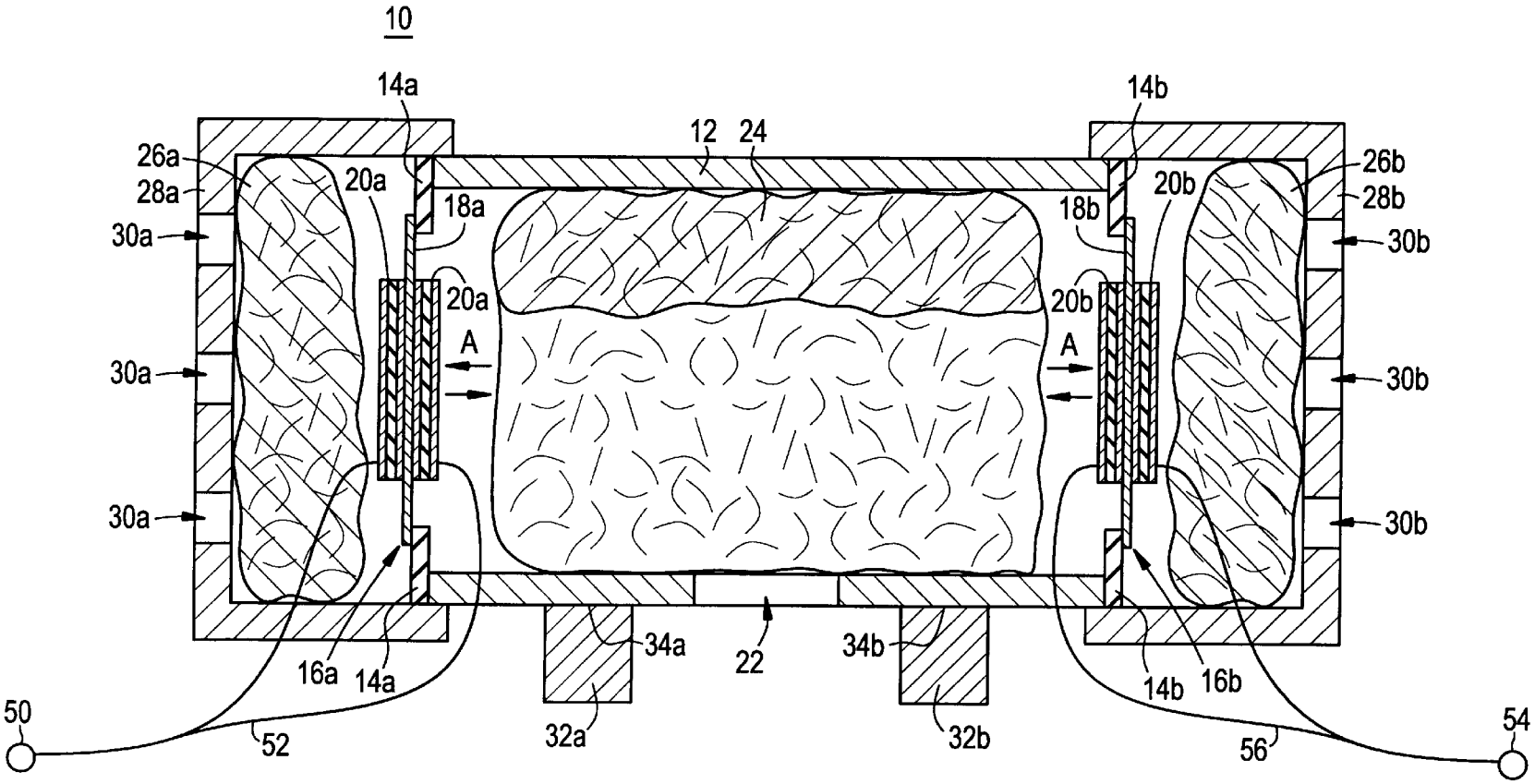
FIG. 2 is a diagrammatic section view of the piezoelectric speaker shown in FIG. 1.

FIG. 1 is a perspective view showing one exemplary mode of the preferred embodiments of the present invention and FIG. 2 is a diagrammatic section view thereof. A piezoelectric speaker 10 shown in FIGS. 1 and 2 preferably comprises a substantially cylindrical main body 12 made of synthetic resin, for example. In one example of the preferred embodiments of the present invention, the speaker 10 may have the dimensions of about 250 mm in length, about 114 mm in outer diameter and about 107 mm in inner diameter. A first sounding member 16*a* is disposed at an aperture of a first end of the main body 12 in the longitudinal direction thereof in an air tight arrangement. The first sounding member 16*a* is connected to the main body 12 via a ringed damper 14*a* preferably made of rubber. For example, the damper 14*a* preferably has an outer diameter of about 114 mm and an inner diameter of about 90 mm. That is, a first sounding member 16*a* preferably comprises a disk-like diaphragm 18*a* preferably having a diameter of about 100 mm and is preferably made of metal, for example.

Disk-shaped piezoelectric elements 20*a* are preferably secured to the diaphragm 18*a* in a bimorph arrangement preferably at the approximate center of the two main surfaces of the diaphragm 18*a* to provide a source of vibration. The peripheral portion of the diaphragm 18*a* is adhered to an edge surface of the aperture of a first end of the main member 12 in the longitudinal direction thereof via the damper 14*a*. Accordingly, the vibrating portion of the sounding member 16*a* is the part of the first sounding member 16*a* which does not contact the damper 14*a*.

Similarly, a second sounding member 16*b* is secured to a second end of the main body 12 in the longitudinal direction thereof in an air tight arrangement. The second sounding member 16*b* is secured to the main body 12 via a ringed damper 14*b* preferably made of rubber, for example. The damper 14*b* may preferably have an outer diameter of about 114 mm and an inner diameter of about 90 mm. That is, the second sounding member 16*b* preferably comprises a disk-like diaphragm 18*b* preferably having a diameter of about 100 mm and preferably made of metal, for example. Disk-shaped piezoelectric elements 20*b* are secured to the diaphragm 18*b* in a bimorph arrangement preferably at the approximate center of the two main surfaces of the diaphragm 18*b* to provide a source of vibration. The peripheral portion of the diaphragm 18*b* is adhered to an edge surface of the aperture of the other end of the main body 12 in the longitudinal direction via damper 14*b*. Accordingly, the vibrating portion of the second sounding member 16*b* is the part of the member 16*b* which does not contact the damper 14*b*.

Further, a substantially circular external opening 22 is preferably formed at the approximate center part of the side of the main body 12 in the longitudinal direction. In one example, it is preferred that the opening 22 is created so as to be about 30 mm in diameter so as to have an area of about 1/10 of an area of the vibrating portion of one sounding member 16*a* or the other sounding member 16*b*. The opening 22 radiates sound waves generated within the main body 12 by the sounding members 16*a* and 16*b* to the outside of the main body 12 while enlarging an amplitude of the sound waves. Further, a sound absorbing member such as glass wool 24 is preferably provided within the main body 12 along an inner wall thereof, except at a location of the external opening 22, for functioning as a sound absorber for absorbing and attenuating a component of the sound waves located in the high sound range.

A sound absorbing material such as glass wool 26*a* is also preferably provided on the outside of the first sounding member 16*a* for functioning as a sound absorber for absorbing and attenuating a component of the sound waves in the high sound range. A substantially cylindrical cap 28*a* preferably made of synthetic resin for example is preferably secured to the aperture part of the first end of the main body 12 in the longitudinal direction so as to cover the sound absorbing member 26*a*. A plurality of substantially circular holes 30*a* for example are created at the bottom of the cap 28*a* to attenuate the component of sound waves in the high sound range.

In the same manner, a sound absorbing member such as glass wool 26*b* is preferably also provided on the outside of the second sounding member 16*b* to function as a sound absorber for absorbing and attenuating a component of the sound waves in the high sound range. Further, a substantially cylindrical cap 28*b* preferably made of synthetic resin for example is secured to the aperture part of the second end of the main body 12 in the longitudinal direction so as to cover the sound absorbing member 26*b*. A plurality of substantially circular holes 30*b* for example are created at the bottom of the cap 28*b* to attenuate the component of the sound waves in the high sound range.

It is noted that the piezoelectric elements 20*a* of the first sounding body 16*a* are connected with a first input terminal 50 provided on the outside of the main body 12 via lead wires 52 and that the piezoelectric elements 20*b* of the second sounding body 16*b* are connected with a second input terminal 54 provided on the outside of the main body 12 via other lead wires 56. At this time, the piezoelectric elements 20*a* of the first sounding member 16*a* are connected with the first input terminal so that the first sounding member 16*a* vibrates when an electrical signal is input to the first input terminal and the piezoelectric elements 20*b* of the second sounding member 16*b* are connected with the second input terminal so that the second sounding member 16*b* vibrates when an electrical signal is input to the second input terminal.

The main body 12 is preferably supported on two leg members 32*a* and 32*b*. The two leg members 32*a* and 32*b* preferably have concave portions 34*a* and 34*b* which are curved surface which substantially corresponds to the side surface of the main body 12, respectively, to support the main body 12 thereon.

When a first channel signal of a stereo signal and a second channel signal thereof are input respectively to the first input terminal and the second input terminal so as to drive the first and second sounding members 16*a* and 16*b* such that pressure within the main body 12 increases or decreases in directions shown by arrows A in FIG. 2 at the sounding members 16*a* and 16*b* at the same time in the piezoelectric speaker 10, sound waves are generated within the main body 12 by the sounding members 16*a* and 16*b* and are radiated from the external opening 22 of the main body 12. Further, sound waves are generated within the caps 28*a* and 28*b* by the sounding members 16*a* and 16*b* and are radiated from the plurality of holes 30*a* and 30*b* of the caps 28*a* and 28*b*.

At this time, resonation or vibration is generated by the main body 12 and the opening 22 through sound waves generated from the two sounding members 16*a*, 16*b* to the main body 12. A reproduced sound which is increased or emphasized as a result of the resonation is radiated from the opening 22 of the main body 12 to outside thereof.

Because the area of the external opening 22 of the main body 12 is smaller than the area of the vibrating portion of the sounding members 16*a* or 16*b* in this case, the amplitude of the sound waves radiated from the opening 22 of the main body 12 becomes larger than the amplitude of the sound waves generated within the main body 12 from the sounding members 16*a* and 16*b*. As a result, the piezoelectric speaker 10 has a substantially reduced size and reproduces the sound waves in the low sound range without using a large diaphragm, a large case or a large baffle plate.

Here, there is no phase difference between the low sound range of the sound waves generated by the first channel signal and the low sound range of the sound waves generated by the second channel signal. Therefore, the low sound range of the sound waves generated by the first channel signal and the low sound range of the sound waves generated by the second channel signal are superimposed within the main body 12, thereby reproducing an increased or doubled sound. Since this increased reproduced sound is radiated from the opening 22 of the main body 12 toward the outside thereof, sufficient sound pressure can be attained although the main body 12 and the sound member 16 comprising piezoelectric elements have a relatively small size. Thus, according to the preferred embodiments of the present invention, a small-sized piezoelectric speaker 10 which can radiate sound waves at a sufficient sound level and the low sound range is achieved.

Note that there is a phase difference of 180° between the middle-high sound range of the sound waves generated by the first channel signal and the middle-high sound range of the sound waves generated by the second channel signal. Thus, those high-middle sound ranges are canceled within the main body 12, thereby radiating no middle-high sound range from the opening 22 of the main body 12. Therefore, the low sound range of the sound waves is emphasized.

Also, due to the sound waves generated within the cover members 28*a* and 28*b* through the sounding members 16*a* and 16*b*, resonation or vibration is generated by the cover members 28*a*, 28*b* and the holes 30*a*, 30*b*. The reproduced sound which is increased or emphasized as a result of this resonation is radiated from the holes 30*a*, 30*b* toward the outside of the cover members 28*a*, 28*b*.

Here, the resonant frequency is represented from Helmholtz rule by the following equation:

$$f = \frac{c}{2\pi}\sqrt{\frac{\pi r^2}{V(l + 1.3r)}}$$

In the above equation, f represents a resonant frequency, c is a sound velocity, V represents a volume for a resonant vessel, r is a radius of the opening and l represents the thickness of the resonator.

Figure 4:
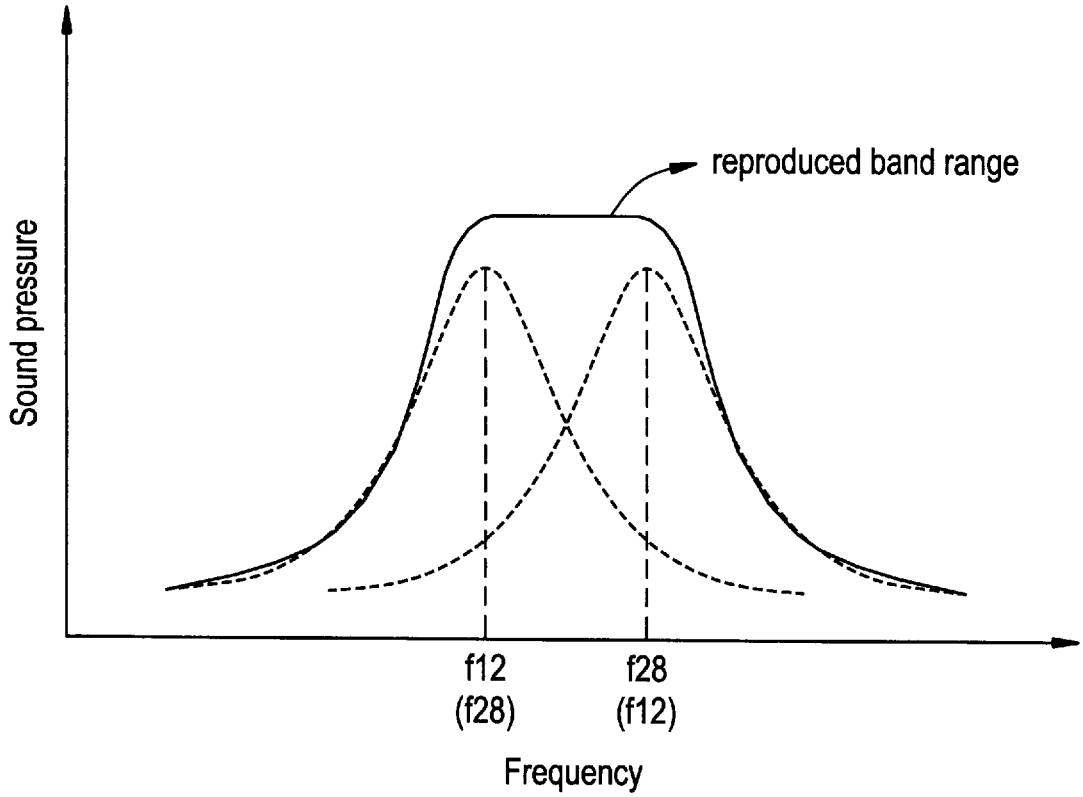
FIG. 4 is a graph showing the sound pressure and the resonant frequency of sound in the main body and in the chambers defined between the main body and a first cover member and between the main body and a second cover member of the speaker shown in FIG. 1.

In the speaker 10, when the resonant frequency in the main body 12 is represented by $f_{12}$ and the resonant frequency inside of each of the cover members 28*a*, 28*b* is represented by $f_{28}$ (assuming the resonant frequencies inside the cover members are equal), the speaker 10 can be constructed so that $f_{12}$ is different from $f_{28}$ (i.e. $f_{12} \neq f_{28}$). As shown in FIG. 4, a reproduced band of the low sound range is expanded, thereby improving the sound level of the low sound range reproduced from the speaker 10.

Further, because the sound absorbing member 24 absorbs and attenuates the component of the sound waves in the high sound range generated within the main body 12 by the sounding members 16*a* and 16*b*, the output of low sound range of the sound waves thus reproduced is increased as a result.

Because the sound absorbing members 26*a* and 26*b* absorb and attenuate the components of the sound waves in the high sound range generated within the caps 28*a* and 28*b* by the sounding members 16*a* and 16*b*, the output low sound range of the sound waves thus reproduced is further increased as a result.

Because the components of the sound waves in the high sound range are attenuated also by the holes 30*a* and 30*b* of the caps 28*a* and 28*b*, the output of the low sound range of the sound waves thus reproduced is further increased.

It is noted that a phase difference between the sound waves generated within the main body 12 by the sounding members 16*a* and 16*b* and the sound waves generated within the caps 28*a* and 28*b* by the sounding members 16*a* and 16*b* is 180°. However, the sound waves radiated from the external opening 22 of the main body 12 and the sound waves radiated from the holes 30*a* and 30*b* of the caps 28*a* and 28*b* do not cancel each other out because the main body 12, the opening 22, the caps 28*a* and 28*b* and the holes 30*a* and 30*b* function as a detour or sound wave guide so that the sound waves are superimposed and sound pressure is substantially increased in the piezoelectric speaker 10.

Figure 3:
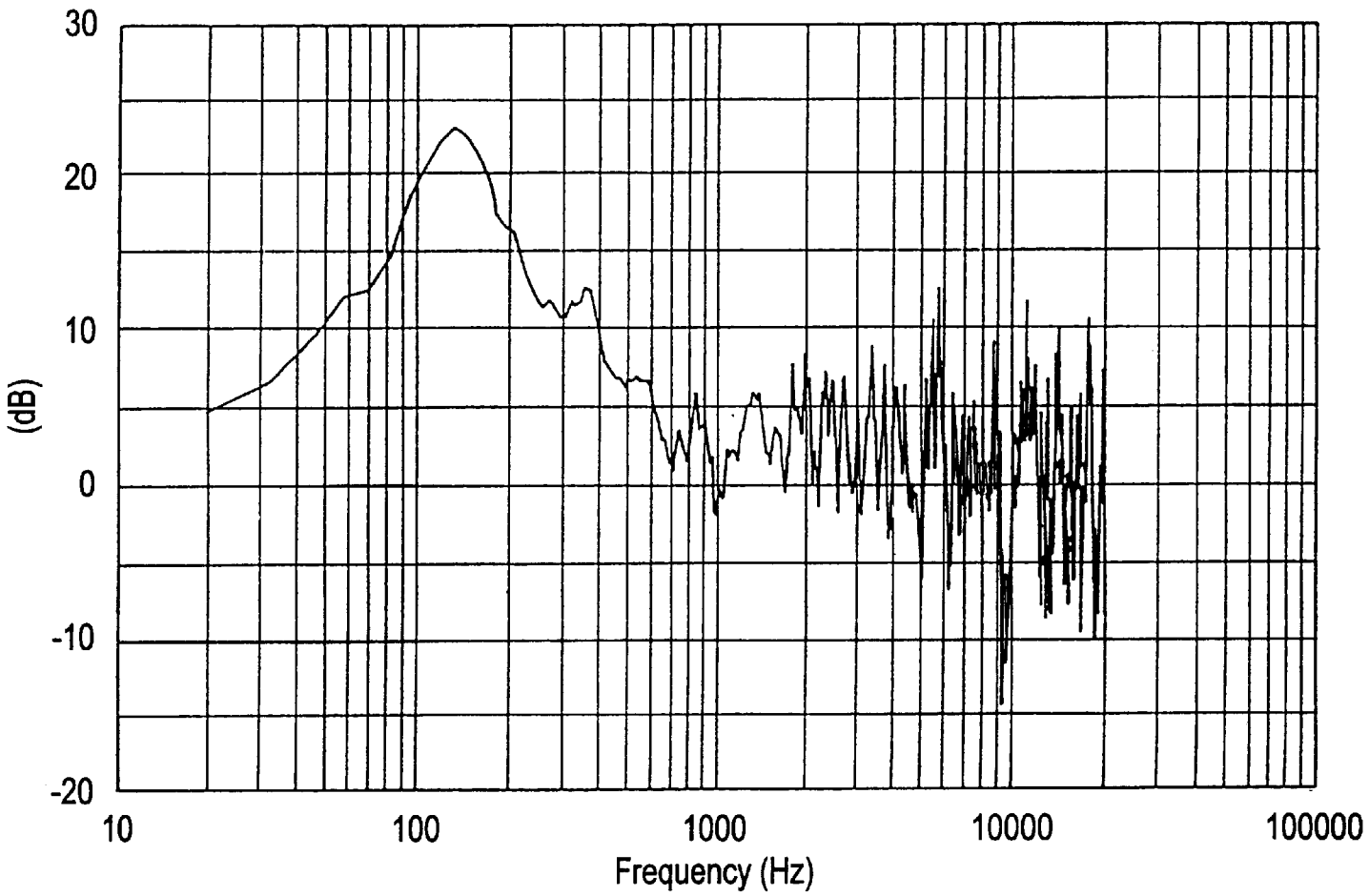
FIG. 3 is a graph showing a frequency characteristic of the piezoelectric speaker shown in FIGS. 1 and 2.

FIG. 3 is a graph showing a frequency characteristic of preferred embodiments of the piezoelectric speaker 10. As is apparent from the graph shown in FIG. 3, the piezoelectric speaker 10 reproduces sound waves in the low sound range.

Further, the piezoelectric speaker 10 may be used as a low sound range speaker at the center of a 3D system because one channel signal of a stereo signal is input to the first sounding member 16*a* via the first input terminal and the other channel signal of the stereo signal is input to the second sounding member 16*b* via the second input terminal. It is noted that it is not necessary to provide two independent piezoelectric speakers for respective channels of the stereo signal to reproduce the component in the low sound range of the stereo signal because there is no directivity in the low sound range and the components in the low sound range of the stereo signal are in the same phase in both channels. Also, no network is necessary.

This piezoelectric speaker 10 also allows a reproducing frequency to be changed by changing the length or the inner diameter of the main body 12 or the size or the shape of the opening 22.

Further, this piezoelectric speaker 10 produces a larger amplitude obtained by matching a resonance frequency of the sounding members 16*a* and 16*b* with a resonance frequency which is determined by the opening 22 of the main body 12 and the like. Thus, the speaker 10 avoids the problems with a deficiency of the low sound range which is caused by the deficiency of the amplitude, which has been a disadvantage of conventional piezoelectric speakers.

It is noted that the piezoelectric speaker 10 allows a reproducing band to be widened by adequately separating the resonance frequency of the sounding members 16*a* and 16*b* from the resonance frequency of the main body 12.

Figure 5:
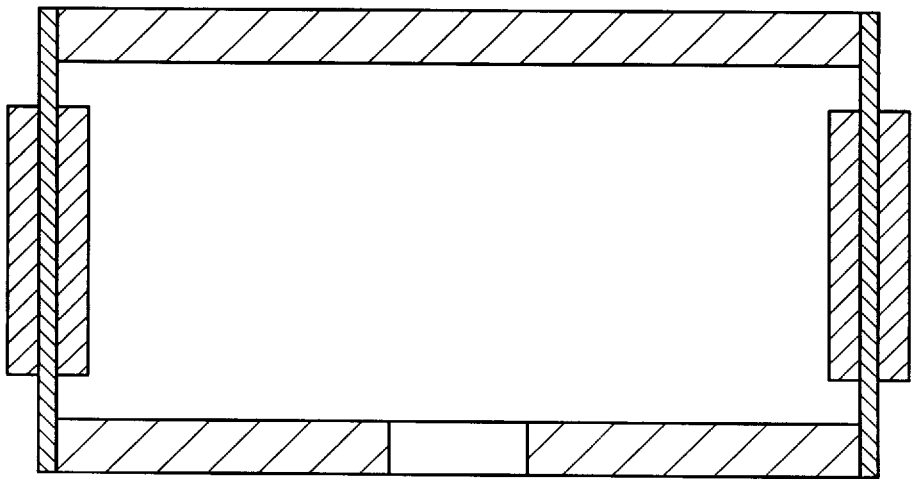
FIG. 5 is an alternative embodiment of the present invention in which cover members shown in FIG. 1 are omitted.

In the above preferred embodiments of the present invention, two cover members are provided so that they cover two sounding members. However, as shown in FIG. 5, a cover member may be dispensed with in accordance with its design and usage. But since the two sounding members are protected and the sound pressure of the reproduced low sound range is improved by the cover members, it would be preferable to provide cover members.

Although the main body is preferably formed to have a substantially cylindrical shape in the preferred embodiments described above, the main body may be formed into a shape of square tube for example, and other shapes. Similarly, the end caps may be formed into a shape of bottomed pipe such as a square bottomed pipe. Further, the shape of the leg members may be modified in accordance to the shape of the main body.

Further, the diaphragm and piezoelectric elements of the sounding body may be formed into other shapes such as a square plate.

The main body, the caps and the leg members may be made of metal, wood, ceramics, glass or other suitable materials.

The diaphragm of the sounding body may be also made of rubber, synthetic resin or other suitable materials.

In the above preferred embodiments, a plurality of holes are provided in the cover member. However, it is not restricted to this. One hole may be provided in the cover member.

In addition, the sounding members including the piezoelectric elements in the bimorph arrangement using two layers of piezoelectric ceramics are provided in the preferred embodiments described above, sounding members using piezoelectric elements arranged in a unimorph structure using one layer of piezoelectric ceramics or sounding members using piezoelectric elements in a laminated structure using three or more layers of piezoelectric ceramics may be used in the preferred embodiments of the present invention.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A piezoelectric speaker, comprising:

an outer case including an external surface having a first external opening at a first end of the outer case and a second external opening at a second end of the outer case and a main body disposed between the first end and the second end, the main body including a first aperture and a second aperture;

a first sounding member located at the first aperture of said main body, the first sounding member including at least one first piezoelectric body which is arranged to be vibrated in response to receiving electrical signals; and a second sounding member located at the second aperture of said main body, the second sounding member including at least one second piezoelectric body and which is arranged to be vibrated in response to receiving electrical signals; wherein said first and second piezoelectric bodies are arranged to be vibrated in a direction in which internal pressure of said main body increases or decreases at said first and second sounding members;

the outer case has a third external opening located at the main body and having an area smaller than an area of a vibrating portion of each of said first and second sounding members.

2. The piezoelectric speaker according to claim 1, wherein sound absorbers for absorbing and attenuating components of sound waves in a high sound range are provided at least one of within said main body, on an outside of said first sounding member and on an outside of said second sounding member.

3. The piezoelectric speaker according to claim 1, wherein a first input terminal for inputting a first channel signal of a stereo signal is connected with said first sounding member and a second input terminal for inputting a second channel signal of said stereo signal is connected to said second sounding member.

4. The piezoelectric speaker according to claim 1, wherein said first external opening is located at a side portion of said outer case.

5. The piezoelectric speaker according to claim 1, wherein a first cover member is provided outside of the first sounding member so that the first cover member covers the first sounding member, and a second cover member is provided outside of the second sounding member so that the second cover member covers the sounding member, wherein the main body and the first and second cover members define the outer case.

6. The piezoelectric speaker according to claim 5, wherein a first resonant frequency inside the first cover member is different from a third resonant frequency inside the main body, and a second resonant frequency inside the second cover member is different from the third resonant frequency inside the main body.

7. The piezoelectric speaker according to claim 6, wherein the first resonant frequency is the same as the second resonant frequency.

8. The piezoelectric speaker according to claim 5, wherein the first and second cover members have sound openings at an outer surface thereof, respectively.

9. The piezoelectric speaker according to claim 8, wherein a first group of middle-high sound waves emitted from the external opening of the main body and a second group of middle-high sound waves emitted from the sound openings in the first and second cover members have a phase difference of about 180 degrees and a sound wave guide is defined by the main body, the external opening in the main body, the first and second cover members and the sound openings in the first and second cover members such that a first group of low sound waves and a second group of low sound waves do not cancel each other but are superimposed on each other to thereby increase sound pressure.

10. A speaker according to claim 1, wherein the first and second sounding members include first and second dampers, respectively, for connecting the first and second sounding members to the main body in an air-tight arrangement.

11. A speaker according to claim 10, wherein the vibrating portion of each of said first and second sounding members is a portion of the first and second sounding members which does not contact a respective one of the first and second dampers.

12. A speaker according to claim 1, wherein each of the first and second sounding members includes a plurality of piezoelectric elements.

13. A speaker according to claim 12, further comprising a first and second diaphragm, the plurality of piezoelectric elements of each of the first and second sounding members being secured to a respective one of the first and second diaphragms.

14. A piezoelectric speaker, comprising:

an outer case including a first sound producing chamber and a first external opening for emitting sound waves therefrom to outside of the speaker, the outer case including a main body;

a first cap provided at a first end of the outer case and defining a second sound producing chamber, the first cap including second external openings for emitting sound waves therefrom to outside of the speaker;

a second cap provided at a second end of the outer case and defining a third sound producing chamber, the second cap including third external openings for emitting sound waves therefrom to outside of the speaker;

a first sounding member located between the first sound producing chamber and the second sound producing chamber and adapted to be vibrated to emit sound waves; and a second sounding member located between the first sound producing chamber and the third sound producing chamber and adapted to be vibrated to emit sound waves, wherein the first external opening of the outer case has an area smaller than an area of a vibrating portion of each of the first and second sounding members, and the first, second and third external openings being arranged such that sound waves generated by the first sounding member are emitted from the second external openings to outside of the speaker and are transmitted to the first sound producing chamber, the sound waves generated by the second sounding member are emitted from the third external openings to outside of the speaker and are transmitted to the first sound producing chamber, and the sound waves from the first sounding member and the second sounding member are combined in the first sound producing chamber and are emitted from the first external opening to outside of the speaker.

15. A speaker according to claim 14, wherein the first and second sounding members each comprise at least one piezoelectric member.

16. A speaker according to claim 14, wherein the first sounding member separates the first sound producing chamber and the second sound producing chamber and the second sounding member separates the first sound producing chamber and the third sound producing chamber.

17. A speaker according to claim 14, wherein the first external opening in the main body extends in a direction that is substantially perpendicular to a direction in which second and third external openings of the first and second caps extend.

18. A speaker according to claim 14, wherein the first and second sounding members respectively include first and second piezoelectric bodies arranged to be vibrated in a direction in which internal pressure of said main body increases or decreases at the first and second sounding members.

19. A speaker according to claim 14, wherein sound absorbers for absorbing and attenuating components of sound waves in a high sound range are provided at least one of within the first sound producing chamber, the second sound producing chamber and the third sound producing chamber.

20. A speaker according to claim 14, wherein the first and second sounding members include first and second dampers, respectively, for connecting the first and second sounding members to the main body in an air-tight arrangement.

21. A speaker according to claim 20, wherein the vibrating portion of each of said first and second sounding members is a portion of the first and second sounding members which is not in contact with a respective one of the first and second dampers.

22. A speaker according to claim 14, wherein each of the first and second sounding members includes a plurality of piezoelectric elements, the speaker further comprising a first and second diaphragm, the plurality of piezoelectric elements of each of the first and second sounding members being secured to a respective one of the first and second diaphragms.

23. A speaker according to claim 14, wherein a first group of middle-high sound waves emitted from the first external opening of the outer case and a second group of middle-high sound waves emitted from the second and third external openings have a phase difference of about 180 degrees and a sound wave guide is defined by the main body, the first external opening in the outer case, and the first and second caps and the second and third external openings such that a first group of low sound waves and a second group of low sound waves do not cancel each other but are superimposed on each other to thereby increase sound pressure.

* * * * *